United States Patent [19]

Stratmann et al.

[11] Patent Number: 5,042,216

[45] Date of Patent: Aug. 27, 1991

[54] LOCKING ELEMENT FOR A WALL FACADE STRUCTURE

[75] Inventors: Hans Stratmann, Werl; Franz-Josef Schweins, Hamm, both of Fed. Rep. of Germany

[73] Assignee: Mannesmann AG, Düsseldorf, Fed. Rep. of Germany

[21] Appl. No.: 453,316

[22] Filed: Dec. 21, 1989

[30] Foreign Application Priority Data

Dec. 22, 1988 [DE] Fed. Rep. of Germany ..... 3843737

[51] Int. Cl.[5] ..... E04C 1/40

[52] U.S. Cl. ..... 52/509; 16/221; 52/506; 52/511

[58] Field of Search ..... 52/509, 235, 506, 511; 16/221, 222, 223, 224, 234, 236, 263, 282, 288, DIG. 29

[56] References Cited

U.S. PATENT DOCUMENTS

| | | | |
|---|---|---|---|
| 1,591,815 | 7/1926 | Girdany | 16/221 X |
| 2,885,040 | 5/1959 | Grossman | 52/235 X |
| 3,785,104 | 1/1974 | Dailen | 52/235 X |
| 4,330,970 | 5/1982 | Bonick | 52/235 X |
| 4,352,222 | 10/1982 | Mages et al. | 16/287 |
| 4,887,402 | 12/1989 | Da Col | 52/235 |

*Primary Examiner*—Richard E. Chilcot, Jr.
*Assistant Examiner*—Linda J. Watson
*Attorney, Agent, or Firm*—Nils H. Ljungman & Associates

[57] ABSTRACT

A locking element for a wall facade structure which facilitates accuracy and strength of construction.

16 Claims, 8 Drawing Sheets

LOCKING ELEMENT FOR A WALL FACADE STRUCTURE

BACKGROUND OF THE INVENTION

1. Field of the Invention

The invention concerns a locking element for a facade wall structure made from hollow profiles, or sections.

2. Description of the Prior Art:

A locking element of a similar type is described in European Patent Publication No. 0 181 285. A connecting piece, which can form a locking element, consists of an extension, or extended, profile section or a casting or a forging, which has at least two pintles and one screw opening. The connecting piece can be moved in the longitudinal direction of the hollow section and, on one side, can be completely counter-sunk into the hollow section and, on the other side, can be lifted out of the hollow section with screws which are screwed into a screw channel. This type of arrangement permits the installation of hollow profiles, or sections, between two solidly mounted basic profiles, or sections, on any desired side. Pintles are entered into the borings of the basic section and are secured with pins. The profile, or section, can be fixed in any desirable position by means of a screw. A disadvantage of this is that all parts have to match exactly since larger tolerance deviations can, at best, only be overcome with difficulty or, possibly, not at all. Furthermore, for the attaching of the connecting piece to the basic section, two additional exact fitting bores have to be made. The fitting bores have to be aligned exactly with the bores through which the pintles are guided. It is difficult, during assembly, to insert a plastic plate to, possibly, compensate for the play between the connecting piece and the basic section. The plate will completely obscure the view of the area where the pintles are to be inserted. Further, the plastic plate should be a flexible element so that the total bracing member is not stiff and rigid especially since the screw which enters into the screw channel can only be force gripped such as by wedging. If this screw is not tight, or should it loosen over a period of time, especially with plastic discs positioned between the screw and the profile, then the entire profile could move back and forth.

European Patent Publication No. 0 149 587 discloses another suggestion for the locking element. This device differs from that described above since the attaching of the locking element on the post is not accomplished by pegs, or pins, but rather, through a conical securing screw which is positioned through the threaded bore of the locking element and fastened into a slot into the post. A disadvantage of this device is the arrangement of the pegs, or pins, which permits only hollow sections to connect with long lugs, or projections, which protrude to the outside. A whole hollow profile with a short lug, or projection, has insufficient room for the installation of the bores which accommodate the pegs, or pins. Additionally, the locking element, which may be produced out of light alloys, has projections, recesses, ledges and bevels. The locking elements cannot be produced from steel without the expenditures of high cost. The light metal locking element cannot be utilized with high building construction because of municipal ordinances regarding their fire resistance.

OBJECT OF THE INVENTION

It is an object of the invention to provide a locking element for a facade wall structure which is cost effective to produce, can be universally utilized for all sizes of hollow profiles, or sections, made from steel, has a lug, or projection, which points outward and can be utilized for high rise buildings without violating fire ordinances. A further object is to provide a locking element which can accommodate large tolerance deviations, can be easily fabricated and makes possible a simple and economic mounting of a facade wall.

SUMMARY OF THE INVENTION

An important aspect of the locking element of the present invention is that the bracing of the locking element on the post occurs in at least three locations, which define a triangle. Two of the locations are contact surfaces of pintles, which are fastened to an adapter piece. The third location is the face surface of a guide rail which is attached to the adapter pointing towards the post side. This three point brace, and an embodiment which employs three pintles a four point brace, assures a torque, or twist, resistant connection between the locking bar and post, and accommodates some push and pull or linear movement.

The linear arrangement of the adapter piece, or rather the collar, of the pintle on the inner surface of the locking bar permits, in a simple manner, a fitting of the locking element according to structural conditions of the locking bar. A binding spot can, for instance, be corrected quickly and without problems by the use of a simple file stroke. In view of the customary galvanization of the hollow profiles made from steel, it is especially important because the zinc layer of various thicknesses can lead to binding spots. Furthermore the locking element which is also made of steel is likewise galvanized for reasons of corrosion.

For subordinate purposes of application, the suggested locking element should be produced from light metal such as in form of a diecast, or injection molding. Contrasting to that for the high rise building construction, the carrying element, for example the locking bar and post including the connecting element, may be governed by fire resistance class according to DIN 4102 in certain countries. This means that the temperature of the fire in the fire room in the test performed on a component according to DIN 4102, is greater than 1000 degrees C. depending on the time span.

These demands of the components can only be met if the locking element is produced from steel. The locking bar made out of light metal must be excluded. One advantage of the suggested locking element lies in the fact that the adapter piece can be produced in a simple way by a cutting of the hollow profile and the guiding rail and pintles can be attached thereto. The guiding rail is a section of a bar stock, and a threaded boring is installed in the end area of the guiding rail. The guiding rail can be either attached to the adapter piece by means of screws or a welding seam. The pintles, which have a collar bore contact point with the adapter piece, located on the locking bar side can likewise be attached by means of a welding seam. As an alternate for this, it has been suggested to press the elongated pintle into a hinged type contour in such a manner that the collar of the pintle rest against the face surface of the adapter piece.

In order that different gaskets or connecting profiles, respectively, can be attached in the space between the locking bar end and the post wall, the pintle employs two sections which are different in diameter, whereby the dimension of the smaller sector reaches into the bore of the post. The transfer to the second sector, which is larger in diameter and the collar surface makes up the contact surface of locking element at the post wall which corresponds with the contact surface consisting of the face surface of the post of the guided rail. The latter contact surface rests against the side wall of the lug of the post.

The counter sinking of the locking element can be done in several ways. In the first embodiment it is suggested that a projection be attached to the end of the guided rail which points toward the post and, at least, reaches into the wall area the lug. This projection can be part of a casting or a protruding part of a pintle which has been inserted or a screwed in threaded screw. In most cases, a welding spot, such as a tack weld, is sufficient. The length of the projection is measured in such a way so that, at most, is equal to or smaller than the provided space between locking bar and post wall. In this fashion an insertion of the locking bar between two solidly mounted posts is possible from both sides. In the case of a locking bar with a long lug, the space between a guide rail and the end of the lug has to be bridged and the protrusions in the guide rail must be diagonal to the lug. The attached protrusion, be it a welding spot or the protruding part of a pin or screw, also serves the purpose to prevent an accidental sliding of the locking element into the locking bar. The space between the long lug can be filled by a guide element which is attached to the guiding rail. In the case of single part locking element, this guiding element is part of the casting and, with multiple component locking elements, the guide is produced from a section of a hollow profile and is connected to the guide rail by a welding bead. The length and arrangement of this guiding element is chosen in such a manner that the face surface of the guiding element which faces the post sides is flush with the adapter piece and the dimension on the locking bar side covers at least two of the threaded bores of the guide.

BRIEF DESCRIPTION OF THE DRAWINGS

The following Detailed Description of the Preferred Embodiment may be better understood when taken in conjunction with the appended drawings in which.

DESCRIPTION OF THE PREFERRED EMBODIMENTS

Figure 1:
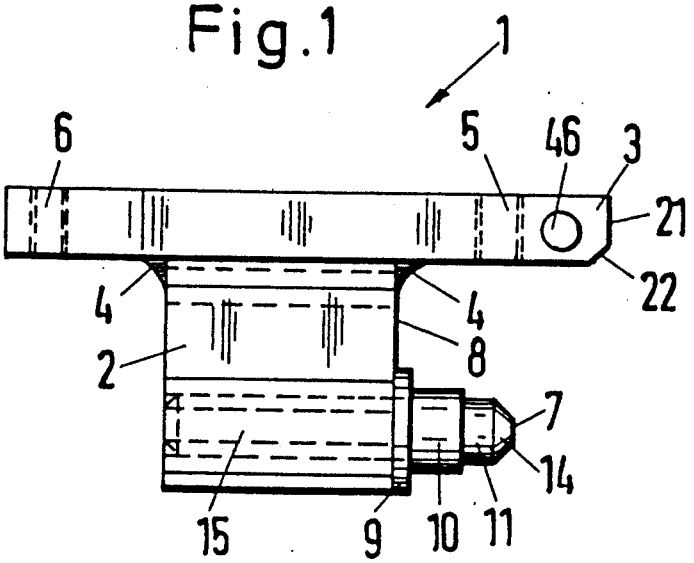
FIG. 1 is a side elevational view of a locking element in accordance with the present invention.
Figure 2:
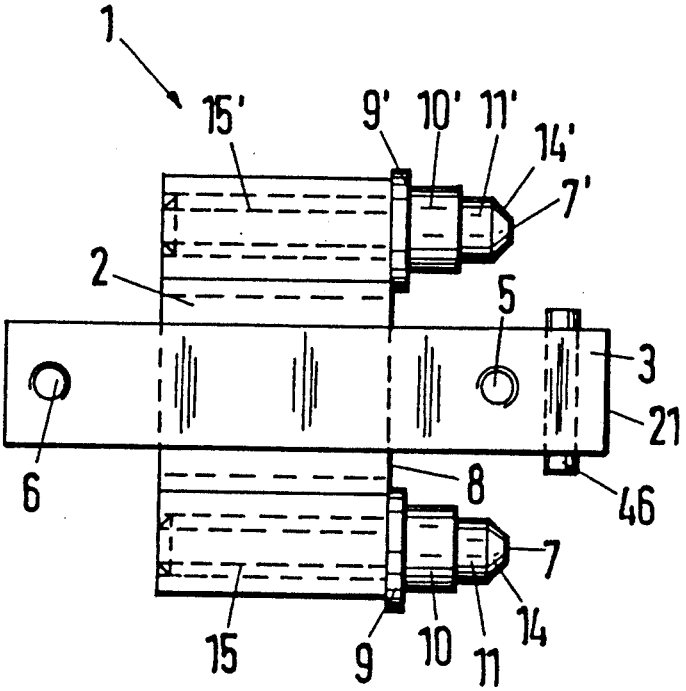
FIG. 2 is a top view of the locking element of FIG. 1.
Figure 3:
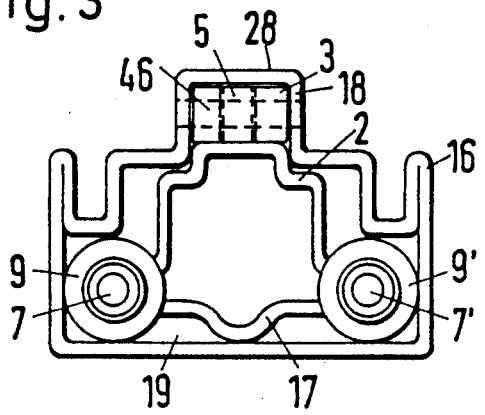
FIG. 3 is a front elevational view, partially in section, of the locking element of FIG. 1, which employs a small locking bar and a short lug.
Figure 4:
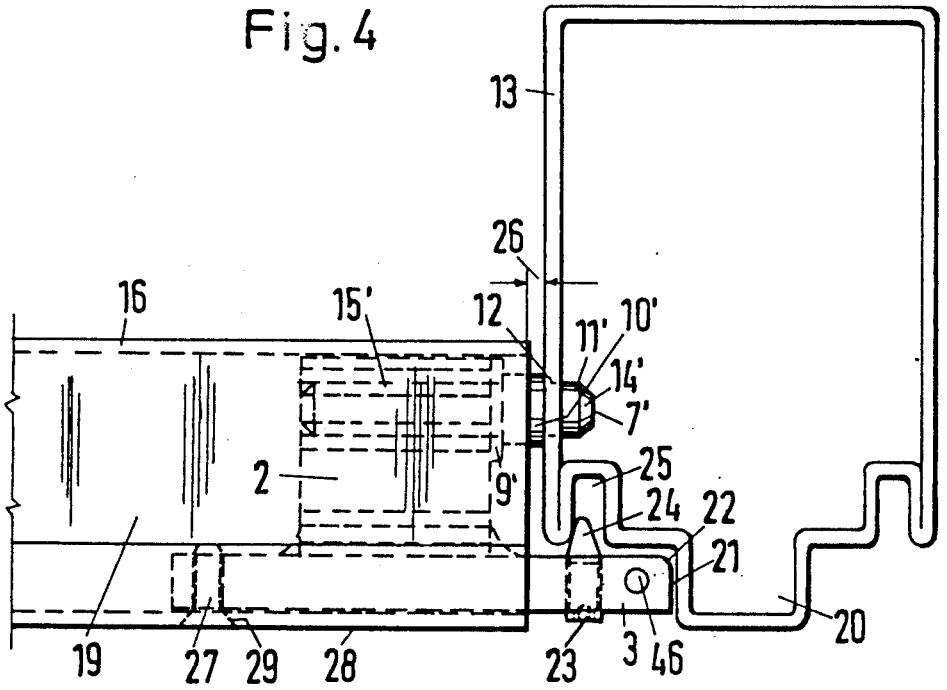
FIG. 4 is a side elevational view, partially in section, of a facade wall construction employing a locking bar or post which has a short lug.

The embodiment of the invention shown in FIGS. 1 through 3 shows locking element 1 as a multi-part element which may be made from steel. Adapter piece 2 is a section, or a hollow profile, to which guide rail 3 is attached, on the side opposite from the facade. Guide rail 3 is produced from a section of bar stock. Guide rail 3 is connected to adapter piece 2 by welding bead 4. Threaded borings 5 and 6 are n the e areas of elongated guide rail 3. The end areas cantilever in the longitudinal direction over adapter piece 2. Pin 46 is in the end area of guide rail 3 which is adjacent posts 13. Pin 46, in this embodiment, is located diagonal to the longitudinal axis of guide rail 3 and is driven into a corresponding boring. Pin 46 cantilevers on both sides beyond the width of guide rail 3 and extends, as shown in FIG. 3, into the wall area of lug 18. This arrangement prevents locking element 1 from unintentionally slipping into locking bar 16 during the tilting of locking bar 16. Instead of pin 46, a threaded pin may be used or two weld spots may, also, be used. Pintles 7 and 7' are swivel parts made from rod material. Collars 9 and 9' lie against the surface of adapter piece 2 which is positioned toward the post. The part of pintles 7 and 7' which is positioned toward the post side consists of two different sections, 10 and 10' and 11 and 11'. The sections have two different diameters. The diameter of the smaller section, 11 and 11', allows the section to enter the corresponding boring 12 of post 13 as a peg or pin as shown in FIG. 4. To allow for easier insertion of the peg or pin of pintles 7' and 7'' and 11 and 11', they are equipped with a truncated cone-like attachment 14 and 14'. The part facing the locking bar of pintles 7 and 7' has a bolt-like elongation 15 and 15' which is pressed into adapter piece 2 in a corresponding hinged-type contour.

In FIG. 3, the linear location of locking element 1 on the inner surface of locking bar 16 facilitates allowance of tolerance deviations. On one side, sections of collars 9 and 9', of pintles 7 and 7', are attached and on the other side an outwardly protruding contour section 17 of adapter piece 2 is attached. Guide rail 3, with its cross-section, extends into lug, or projection, 18 of locking bar 16 where, at the contact surfaces, some corresponding play may occur. Locking bar 16, as illustrated in FIG. 3, shows small hollow cross-section 19 and a short lug, or projection, 18.

FIG. 4 shows a cross-section of a facade wall structure with a locking bar 16 which has small hollow cross-section 19 and a short lug 18 and is connected with a corresponding post 13, which, likewise, has a short lug 20. This embodiment of the invention is selected when a relatively thin wall, single pane glass is to be inserted in the facade wall structure. Locking element 1, which can be moved in the longitudinal direction of locking bar 16, is intended to be removed after the adjustment, or straightening, of locking bar 16 and peg, or pin, 11 and 11' of pintles 7 and 7' of post 13 are being entered into bore 12,12'. For the easier removal of locking element 1 from locking bar 16, inserted pin 46 can be force fitted by either striking pin 46 with a screwdriver, or other appropriate tool, to reach the protruding end of pin 46 in a fork-like manner and then locking element 1 can be pressed out or pulled out with the tool. The transition from pegs 11 and 11', sections 10 and 10' having a large diameter, up to collars 9 and 9' provides the contact surface for locking element 1 and the wall surface of post 13. Face surface 21, which is facing the post of guide rail 3, is located on the wall of the lug 20 of post 13. In order to avoid any scratches from guide rail 3 on post 13 during movement corresponding edge 22 of guide rail 3 is beveled. The tensional forced locking connection of locking element 1 with post 13 is accomplished by threaded bore 5, which is located on the side facing the post, through guide rail 3. Conical end 24, of stud bolt 23, may be inserted in a known way, into slot 25 of post 13. Adjustable space 26, which is located between the post side, or facing post, face surface of locking bar 16 and the wall of post 13 is determined by screw 27 which enters into a second threaded bore 6 of guide rail 3. Additionally, boring 29, of locking bar 16 which is located on the surface, is pointing away from the facade. Seals, or gaskets, or a corresponding end profile can be inserted into slot 26 to accomplish a flush, or smooth finish of the facade.

Figure 5:
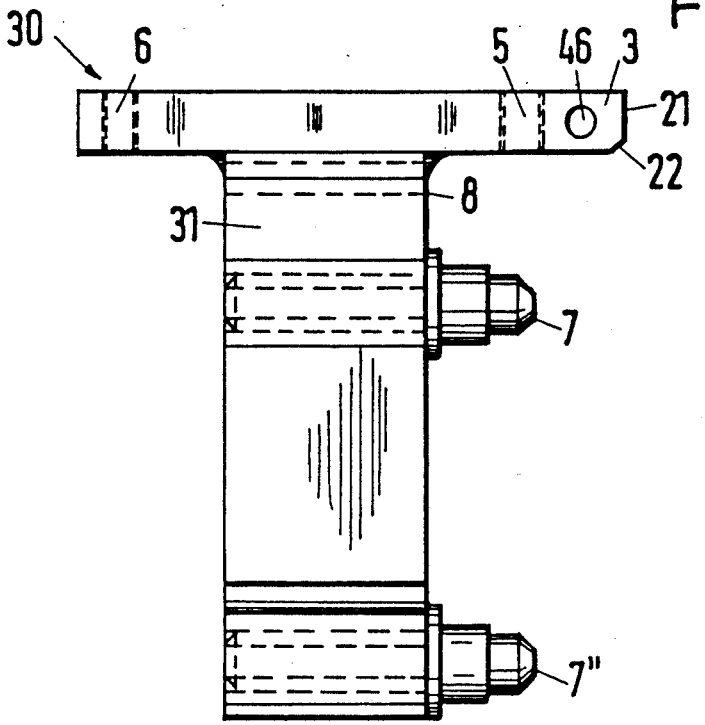
FIG. 5 is a side elevational view of a locking element of the present invention which employs three pintles.
Figure 6:
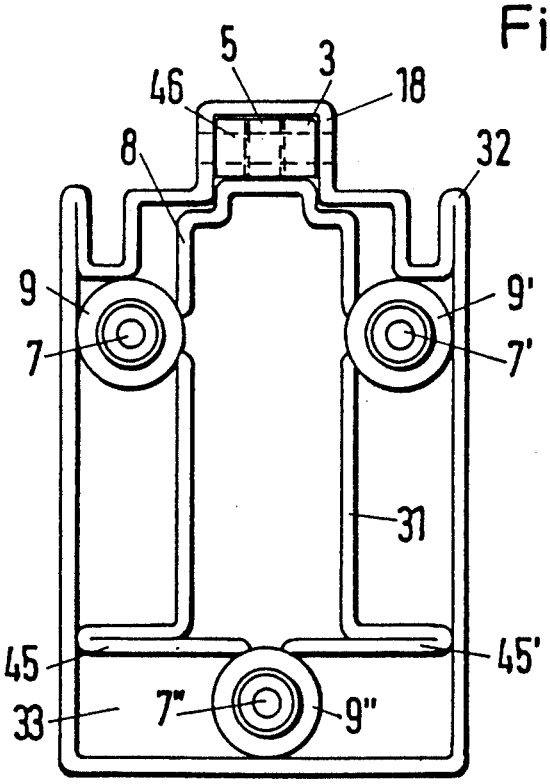
FIG. 6 is a front elevational view, partially in section, of the locking element of FIG. 5 which employs a large locking bar and a short lug.
Figure 7:
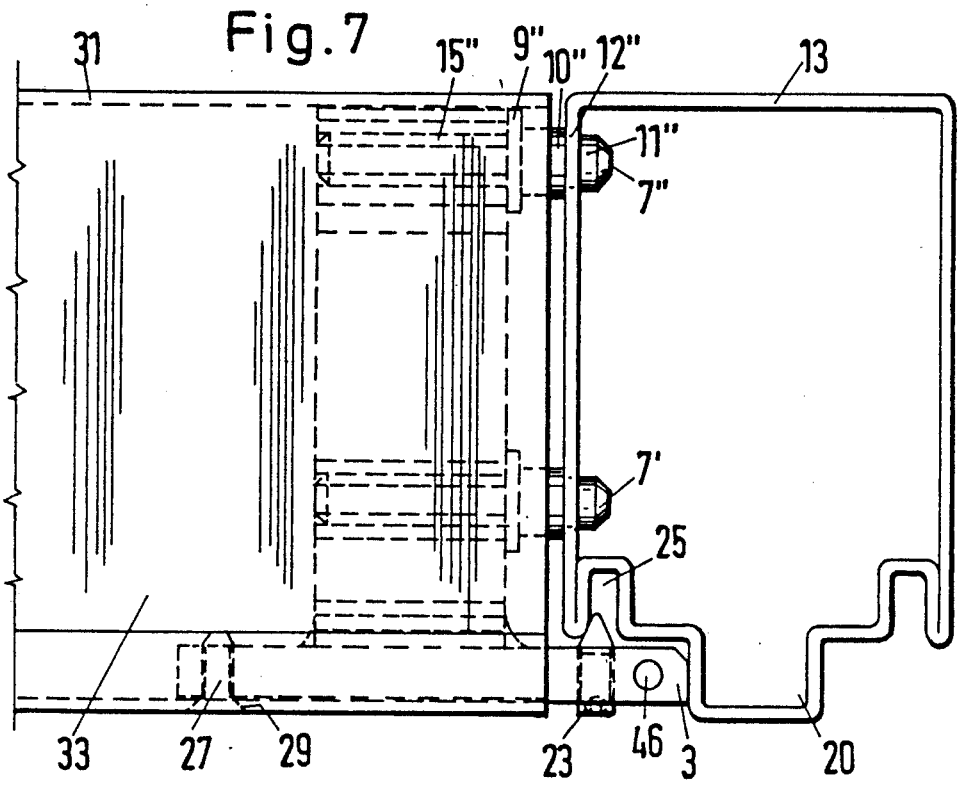
FIG. 7 is a side elevational view, partially in section, of a facade wall construction employing a large locking bar or post which has a short lug.

FIGS. 5 through 7 correspond principally to FIGS. 1, 3 and 4 with the difference being that modified locking element 30 contains three pintles 7, 7' and 7'' whose middle axis furnish the end points of an isosceles triangle, as shown in FIG. 6. Thus locking element 30 has been developed to accommodate locking bar 32 which has a large, hollow cross-section 33 thereby enabling the contact with large post 13 as shown in the drawings. Likewise, there is now a brace at four points, instead of three points as in the previous embodiment. The size of the lug on locking bar 31 and post 13 corresponds to the embodiment shown in FIGS. 1 through 4.

As a comparison to FIG. 3, adapter piece 31 has two contour sections 45 and 45' which are located on the inside surface of locking bar 32, in addition to the sections of collars 9, 9' and 9'', or pintles 7, 7' and 7''.

Figure 8:
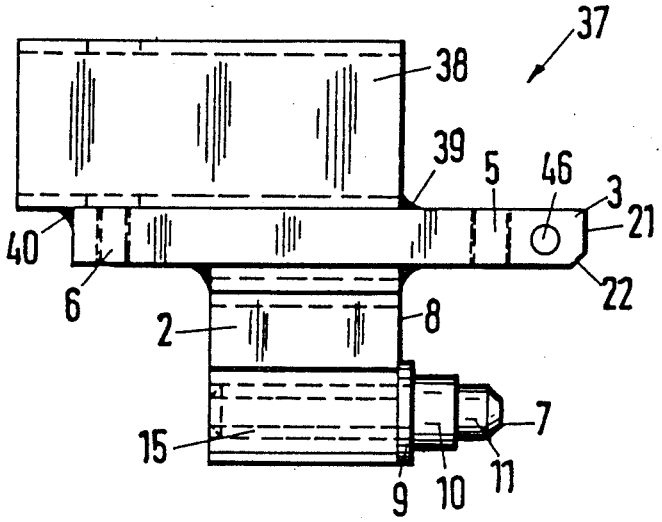
FIG. 8 is a side elevational view of a further embodiment of a locking element in accordance with the present invention which employs an additional guide element.
Figure 9:
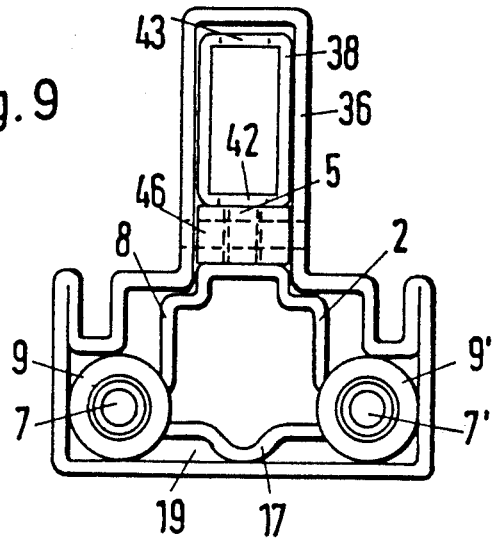
FIG. 9 a front elevational view of the locking element of FIG. 8, partially in section, which employs a small or narrow locking bar and a long lug.
Figure 10:
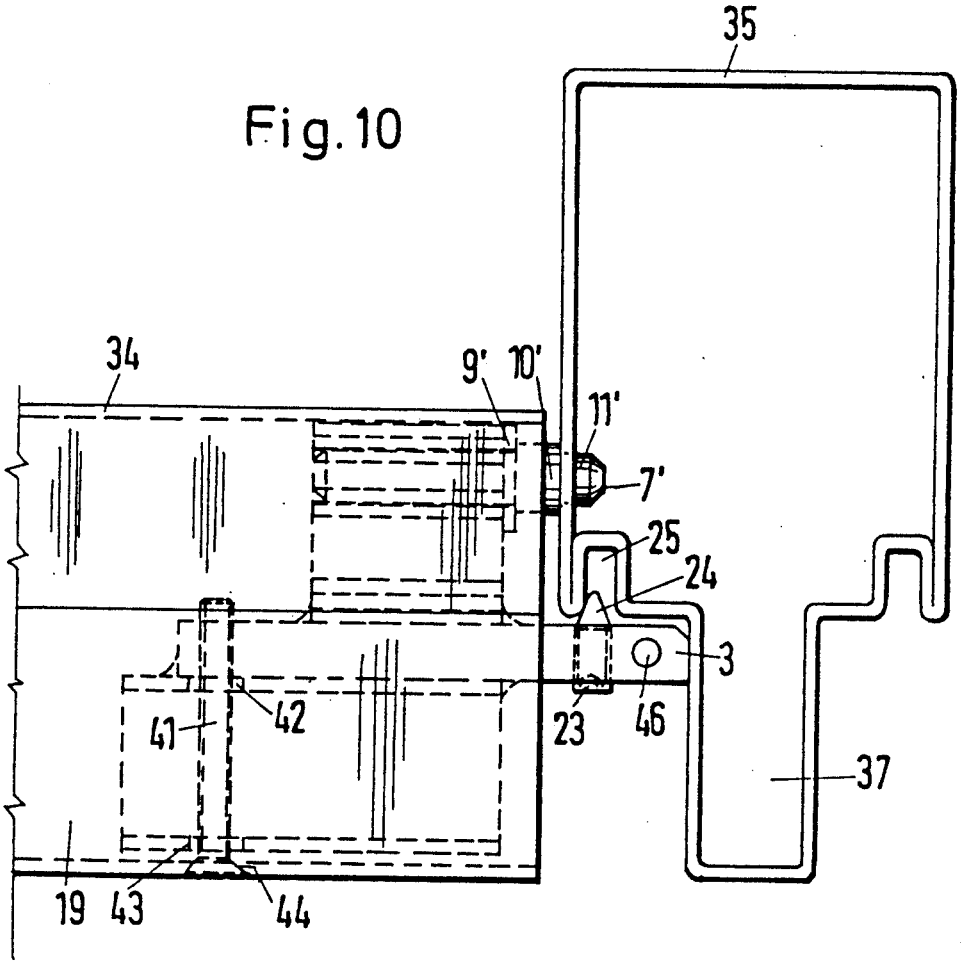
FIG. 10 is a side elevational view, partially in section, of a facade wall construction employing a locking bar or post which employs a long lug.
Figure 11:
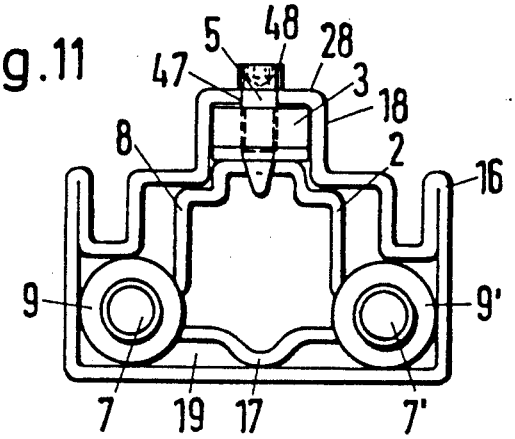
FIG. 11 is a front elevational view of the locking element of FIG. 3, which employs a set screw.
Figure 12:
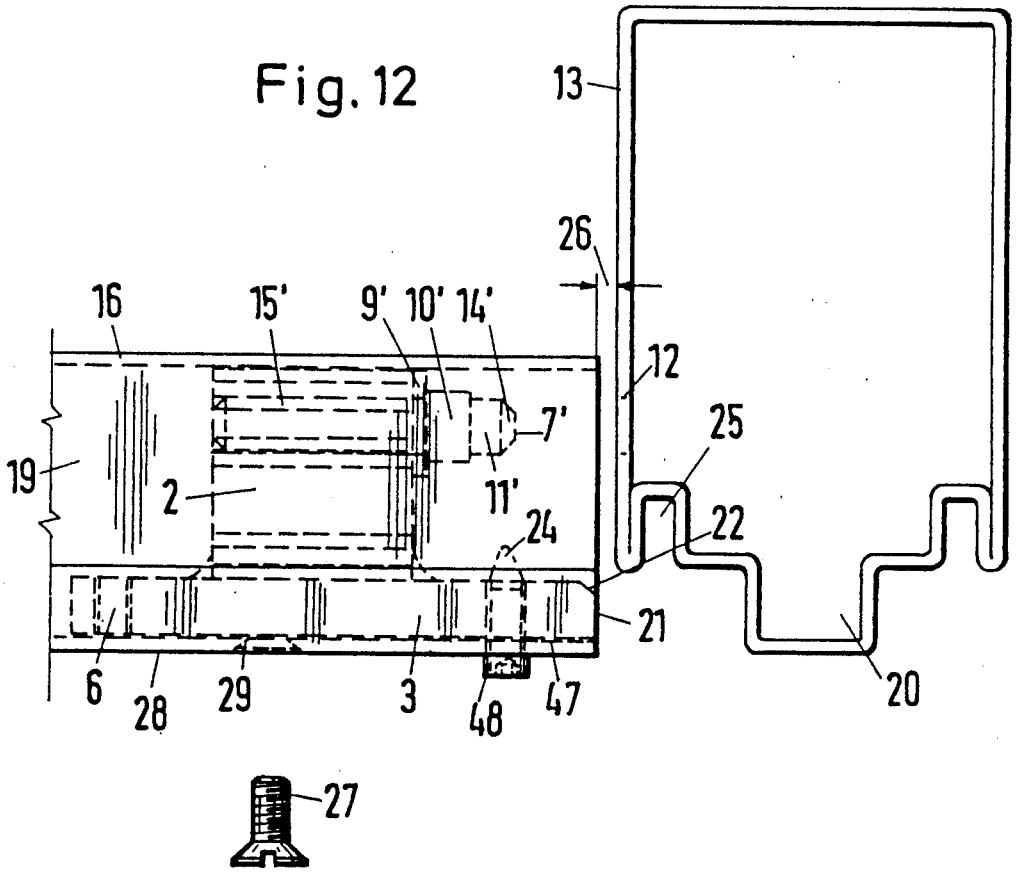
FIG. 12 is a side elevational view, partially in section, of a facade wall construction which employs a locking element with a set screw before the locking element is attached to a post.
Figure 13:
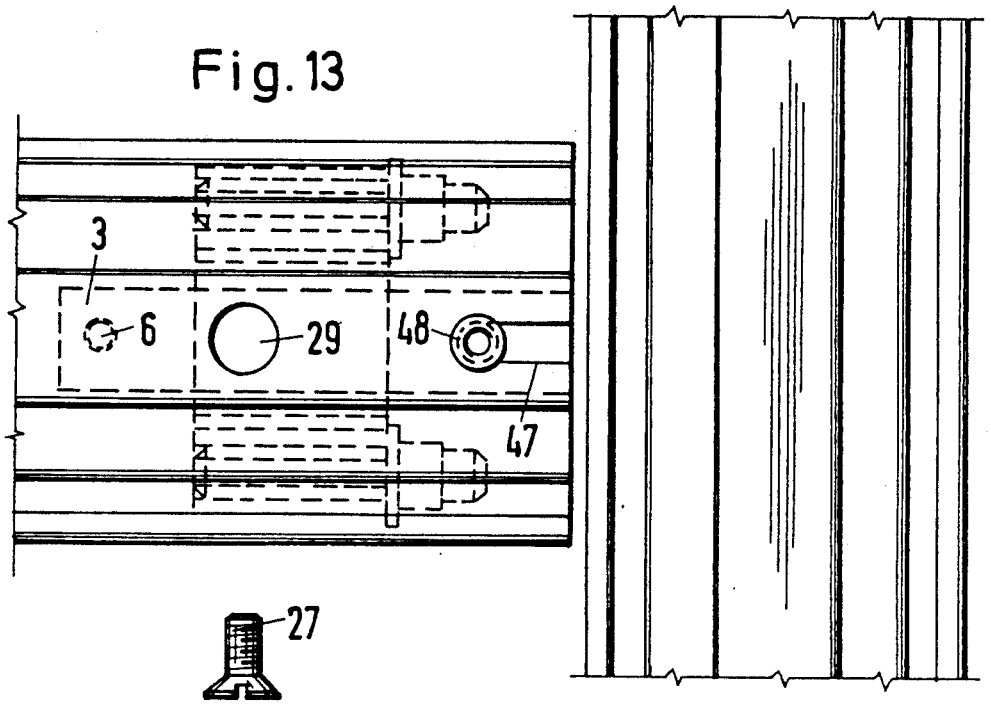
FIG. 13 is a top view of the facade wall construction of FIG. 12.

FIGS. 8 through 10 principally, correspond to FIGS. 1, 3 and 4 with a difference being that locking bar 34, as well as post 35, shows long lug 36 and 37. This profile is chosen when the glass pane is inserted into the facade wall construction and the thickness of the glass is between 20 to 26 mm. In order to fill the space within long lug 36 of locking bar 34, locking element 37 has guiding element 38 which is attached to guide rail 33. Element 38 is a section of a hollow profile and is welded tightly to guide rail 3 by welding seams 39 and 40. In order that long screw 41, which determines the position of locking bar 34, receives some guidance, guiding element 38 contains two aligned borings, 42 and 43, which correspond to boring 44 of locking bar 34.

Figure 14:
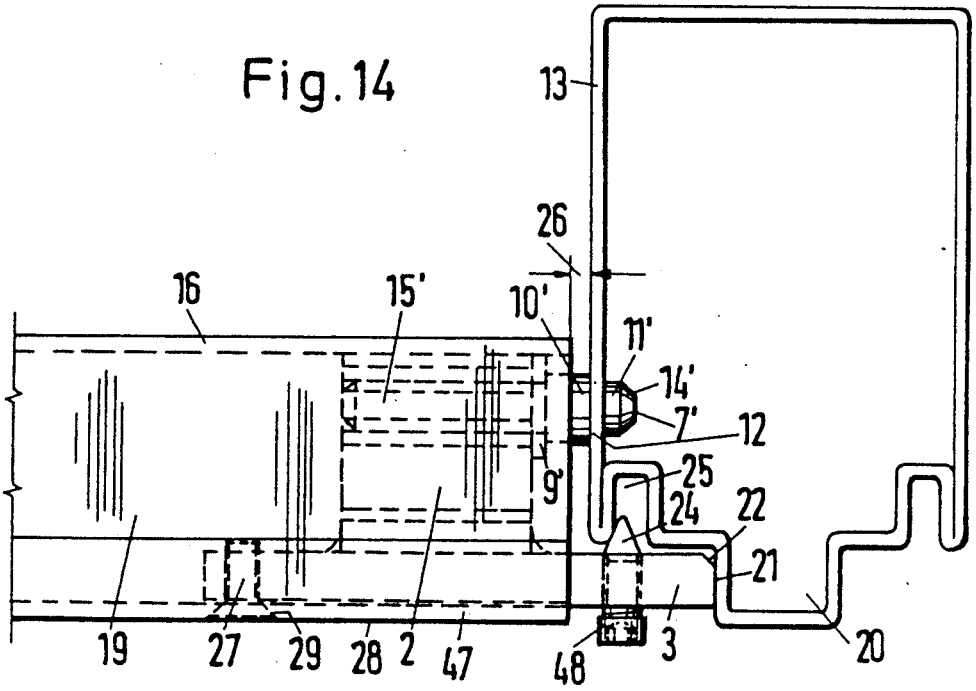
FIG. 14 is a side elevational view, partially in section, of the facade wall construction of FIG. 12, after the locking element is attached to a post.
Figure 15:
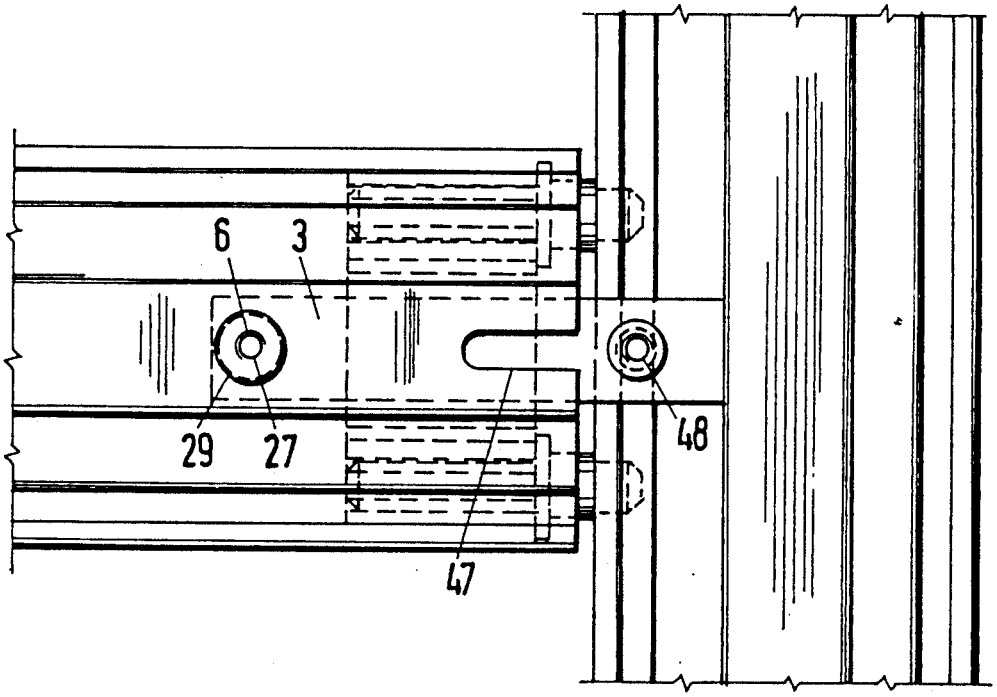
FIG. 15 is a top view of the facade wall construction of FIG. 14.

FIGS. 11 through 14 correspond, principally, to FIGS. 3 and 4 with a difference being that, instead of pin 46, a different arrangement was chosen for the locking of locking element 1 in locking bar 16, whereby a complete counter-sinking of locking element 1 into locking bar 16 is possible. For this purpose locking bar 16 has disconnect element 47 attached to both ends. The width of disconnect element 47 have been chosen in such a manner that the shaft of corresponding screw 48 can be inserted. The longitudinal dimension of disconnect element 47 is matched to the length of locking element 1 and that is in such a manner that after the complete counter-sinking of locking element 1 into locking bar 16, the shaft of screw 48 will rest against the end of disconnect element 47. In this configuration, locking element 1 is wedged, or force fitted, by means of the head of screw 48 so that locking bar 16 can be inserted between the two solidly mounted posts 13. See FIG. 12 and 13. This, probably, becomes important in the event that the gap, or space, 26 between locking bar 16 and the post wall is very small and the distance between posts 13 is small, so that a sufficient tilting of locking bar 16 is not possible for the purpose of insertion. The force fitted arrangement is also advantageous in that premounted locking element 1 cannot slide within locking bar 16 and every tilt position of locking bar 16 is possible. FIGS. 14 and 15 show the above-described arrangement after the insertion of pegs 11 and 11' of locking element 1 into boring 12 on post 13. Instead of stud bolt 23, as shown in FIG. 4, set screw 48 is employed for the locking of locking element 1 against post 13. Set screw 48, as well as the stud bolt 23, has a conical tip 24. See FIG. 14. The locking of locking element 1 in locking bar 16 is done by means of screw 27, which is mounted in the same way as already described with respect to FIG. 4. In addition to the above-mentioned purposes, set screw 48 can be used in an outstanding manner for the removal of locking element 1 from locking bar 16 without any problems.

In summary, one feature of the invention resides broadly in a locking element for a facade structure from hollow profiles with a contact surface at the post side. The locking element can be placed into the locking bar, and can be moved inside as well as tensionally connected and again released. The locking element consists of an adapter piece which has at least two pintles which are solidly anchored and match with the corresponding borings in the posts and are characterized by the fact that the retaining element is developed as an elongated guide rail 3. The guide rail is located on a longitudinal axis within the displacement direction of the locking bar 1. The locking bar end area contains one each of threaded bore 5,6 and cantilevers over adjusting piece 2,31. The guide rail 3 is on the side facing away from the adjusting piece 2,31 which is touching the inner surface of locking bar 16,32,34 in at least one point and is attached in a linear form and extends into an outwardly projecting lug 18,36 of the locking bar 16,32,34. The locking bar face surface 21 which is pointed towards the posts as well as the element protruding from the adapter piece 2,31, rests against post 13,35. The locking of locking element 1 on posts 13,35 is done by a security element [stud bolt] 23 which penetrates guide rail 3 through a threaded boring 5. The treaded boring enters with the conical end 24 into the slot 25 of posts 13,35 and the locking bar 16,32,34 is secured with a predetermined distance 26 to the post wall by means of a screw 27,41. The screw ends reach into the second threaded bore 6 of the guide rail 3 via a boring 29,44 which is located in the lug 18,36 of the locking bar 16,32,34.

Another feature of the invention resides broadly in a locking element which is characterized by the fact that the locking element 1 is built as a one part component, and is a diecasting or injection diecasting and that the adapter piece and the guide rail have, in the direction of movement, flanges located which extend to the outside and the face surfaces of the post sides of the adapter piece, which is likewise equipped with flanges extruding to the outside and additionally one or more surface elements which protrude to the outside.

Yet another feature of the invention resides broadly in a locking element which is characterized by the fact that the locking element 1 consists of several components and that adapter piece 2,31 consists of a section of a hollow profile and that guide rail 3, which consists of a section of bar stock and pintles 7,7',7'', are solidly connected with adapter piece 2,31, and at least one section 17,45,45' and an adapter piece 2,31 and pintles 7,7',7'', which have collars 9,9',9'', in at least one periphial area of collars 9,9',9'' and are located linear on the inside surface of locking bar 16,32,34.

A further feature of the invention resides broadly in a locking element which is characterized by the fact that the guide rail 3 and the pintles 7,7',7'' are connected with an adapter piece 2,31 by means of a welding seam.

A yet further feature of the invention resides broadly in a locking element which is characterized by the fact that pintles 7,7',7'' have a bolt-like extension 15,15',15'' in the direction of locking bar 16,32,34. The bolt-like extension can be fitted into a hinge-type cross-section contour of adapter piece 2,31 and that the collar 9,9',9'' of pintles 7,7',7'' becomes attached to the post 8 of adapter piece 2,31.

Yet another further feature of the invention resides broadly in a locking element which is characterized by the fact that pintles 7,7',7'' have two sections 10,10',10'', 11,11',11'', which have different diameters and a section diameter which is smaller towards the end 11,11',11'' and reaches into the boring 12,12',12'' of post 13,35. The connecting sections 10,10',10'', which reach over to collar 9,9',9'', and the collar surface at the transfer between the first section, 11,11',11'', and the second portion 10,10',10'', together with the post facing frontal area 21 of the guide rail 3 creates the contact surface of post 13,35.

An additional feature of the invention resides broadly in a locking element which is characterized by the fact that guide rail 3 shows a protrusion in the area of the end which points towards the posts. The protrusion runs transverse to the longitudinal axis of guide rail 3 and at least into the wall area of lug 18,36 of the locking bar 16,32,34.

A yet additional feature of the invention resides broadly in a locking element which is characterized by the fact that the arrangement of the elongation of the protrusion is chosen in a way that the protruding part of guide rail 3, after the counter-sinking of adapter piece 2,31, is at a most equal to and for less than the prescribed distance 26 between the locking bar 16,32,34 to the post wall.

A yet further additional feature of the invention resides broadly in a locking element which is characterized by the fact that the protrusion extends in the direction of the lug 18,36 of the locking bar 16,32,34.

A yet further additional feature of the invention resides broadly in a locking element which is characterized by the fact that guide rail 3 displays two protrusions transverse to lug 18,36 of the locking bar 16,32,34.

Another further additional feature of the invention resides broadly in a locking element which is characterized by the fact that the protrusion is part of a casting.

A yet another additional feature of the invention resides broadly in a locking element which is characterized by the fact that the protrusion, or the protrusions respectively, are made from the projecting part of the pin 46 or a screw which is projecting from guide rail 3.

Another yet further feature of the invention resides broadly in a locking element which is characterized by the fact that the protrusion, or protrusions respectively, are made up of a welding point which is located on guide rail 3.

A still further feature of the invention resides broadly in a locking element which is characterized by the fact that the length of the locking bar 16,32,34 and the location of the boring 29,44 in the lug 18,36 of the locking bar 16,32,34 have been chosen in such a manner that the distance of the corresponding face surface of locking bar 16,32,34 towards the post wall corresponds to the required distance 26 after the tightening of locking bar 16,32,34 on the locking element 1.

A still further additional feature of the invention resides broadly in a locking element which is characterized by the fact that on the corresponding end of the locking bar 16,32,34. A disconnecting device 47 is located on the surface of the lug 18,36 which is pointing away from the facade and in which a screwed in screw 48 can be inserted by means of the screw head of the locking element 1 into slit 47 [called disconnect device on other occasions], and the longitudinal dimensions of slit 47 have been selected in such a manner that the part of the guide rail 3 which protrudes beyond the end of the locking bar, which [locking bar] is facing the post, can at least be counter-sunk or total-sunk up to the provided slot 26 between locking bar 16,32,34 and the post wall.

Another still further additional feature of the invention resides broadly in a locking element which is characterized by the fact that an adapter piece 2,31 stores three pintles 7,7',7'' in which the middle axis form the vertices of an isosceles triangle.

Yet another still further additional feature of the invention resides broadly in a locking element which is characterized by the fact that locking bar 34 with a long lug 36 has a guide element which is located in the direction of lug 36 and fills the space for locking bar 34 on the guide rail in the direction of lug 36.

Still another yet further additional feature of the invention resides broadly in a locking element which is characterized by the fact that the guiding element is part of a diecasting.

Another still further yet additional feature of the invention resides broadly in a locking element which is characterized by the fact that the guide element is section 38 of a hollow profile which is solidly connected to guide rail 3.

A yet another still further additional feature of the invention resides broadly in a locking element which is characterized by the fact that the length extension and arrangement for the guide element of guide rail 3 have been chosen in such a manner that the frontal area of the element pointing towards the post is flush with the frontal area 8 of the adapter piece 2,31 and the locking bar side extension at least covers the second threaded bore 6 of guide rail 3 and that the element in this area shows a bore 29,44 of the locking bar 16,32,34 which corresponds to through bore 42,44.

All, or substantially all, of the components and methods of the various embodiments may be used with at least one embodiment or all of the embodiments, if any, described herein.

All of the patents, patent applications, and publications recited herein, if any, are hereby incorporated by reference as if set forth in their entirety herein.

The invention as described hereinabove in the context of a preferred embodiment is not to be taken as limited to all of the provided details thereof, since modifications and variations thereof may be made without departing from the spirit and scope of the invention.

What is claimed is:

1. A locking element for locking together a building facade to a building structure defining an opening in a first surface, said locking element comprising:

first connector means for being connected to the building facade;

second connector means for being connected to the building structure;

said second connector means comprising:

an elongated guide rail defining first and second threaded bores;

at least two peg means connected to said elongated guide rail, each said peg means having a projecting portion for being projected through the opening in the first surface of the building structure and shoulder means for being placed in contact with the first surface of the building structure;

stop means for being placed in contact with a second surface of the building structure; and wedge means for holding said shoulder means in contact with said first surface of the building structure and for holding said stop means in contact with said second surface of the building structure said wedge means defining a conical end portion.

2. A device for locking a building facade to a building structure comprising:

a building facade locking bar defining an interior channel;

a locking element for connection in fixed relation to the building structure;

said locking element being configured to be slidable within said interior channel of said locking bar to vary the distance between said locking bar and the building structure when said locking element is connected in fixed relation to the building structure;

said locking element comprising:

an elongated rail;

at least two pages connected to and projecting from said elongated rail;

said pegs each having a surface for contacting the building structure;

connector means for connecting said locking element in fixed relation to the building structure when said surfaces of said pegs are in contact with the building structure; and attaching means for connecting said locking element in fixed relation to said locking bar to fix the distance between said locking bar and the building structure when and said locking element is connected in fixed relation to the building structure.

3. The device is claim 2, wherein:

the building structure defines at least one opening; and a first of said pegs at least partially projects through said opening.

4. The device of claim 3, wherein:

said first of said pegs defines at least two generally round and concentric peg portions;

said peg portions being connected to one another at a junction;

one of said peg portions defining a shoulder at said junction; and said shoulder being configured to contact the building structure when said first of said pegs at least partially projects through the opening defined by the building structure.

5. The device of claim 4, wherein at least a portion of said elongated rail defines a hollow cross section.

6. The device of claim 5, wherein each said peg includes stem means for connecting each said peg to said elongated rail.

7. The device of claim 6, further including:

an engagement element removably connected to said locking element and said locking bar; and said engagement element for limiting the sliding of said locking element in said interior channel of said locking bar.

8. The device of claim 7, wherein:

at least a portion of said locking element is die cast;

at least a portion of said elongated rail is formed from bar stock;

each of said pegs defines a generally circular cross section; and each said peg is welded to said elongated rail.

9. The device of claim 2, wherein said elongated rail defines a stop surface for contacting the building structure when said locking element is connected in fixed relation to the building structure.

10. The device of claim 9, wherein:

said peg surfaces and said stop surface define a three point support; and said three point support at least partially connects said locking element in fixed relation to the building structure.

11. The device of claim 10, wherein:

said connector means is a bolt; and said attaching means is a screw.

12. The device of claim 11, wherein:

said elongated rail defines an adapter; and said pegs being connected to and projecting from said adapter.

13. The device of claim 12, wherein:

said elongated rail defines a first threaded opening for receipt of said bolt; and said elongated rail defines a second threaded opening for receipt of said screw.

14. The device of claim 13, wherein said elongated rail defines a web.

15. The device of claim 14, wherein:

said pegs each define at least two pintles;

said pintles being solidly anchored and matching with corresponding borings in the building structure;

said elongated rail defining a retaining element;

said locking bar defining a longitudinal axis;

said retaining element defining a longitudinal axis;

said retaining element longitudinal axis being generally parallel to said locking bar longitudinal axis when said locking element is positioned within said locking bar interior channel;

said first threaded openings being a first threaded bore;

said second threaded opening being a second threaded bore;

said locking bar defining an outwardly projecting lug;

said lug defining a face surface;

said lug face surface being directed toward the building structure when said locking element is positioned within said locking bar interior channel and said locking element is connected in fixed relation to the building structure;

said bolt defining a generally conically shaped end portion; and said lug defining a boring for receipt of said screw.

16. The device of claim 15, wherein:

said locking element is constructed as a one part component;

said elongated rail defining flanges which extend to the outside;

said adapter defining a face surface;

said adapter face surface defining flanges which extend to the outside;

said adapter defining a hollow profile;

said pintles being solidly connected to said adapter;

said pintles each defining at least one collar;

each said pintles collar defining peripheral areas on an inside surface of said locking bar;

said pintles being connected to said adapter by a welding seam;

said pintles each having a bolt-type extension corresponding to said longitudinal axis of said locking bar;

said pintle bolt-type extensions being configured to be fitted into hinge-type cross section contour of said adapter;

said pintles each having two sections of different diameters;

said elongated rail defining a first protrusion adjacent to the building structure when said locking element is connected in fixed relation to the building structure;

said elongated rail defining a longitudinal axis;

said first protrusion being positioned generally transversely to said elongated rail longitudinal axis;

said first protrusion extending in the direction of said lug;

said elongated rail defining second and third protrusions positioned generally transversely to said lug;

at least one of said elongated rail first, second and third protrusions being formed by casting;

at least one of said elongated rail first, second and third protrusions defining an opening for receipt of a pin;

at least one of said elongated rail first, second and third protrusions including a welding point;

said locking bar including a disconnecting device;

said disconnecting device being positioning adjacent a surface of said lug;

said disconnecting device including means for receiving a screw;

said disconnecting device pointing away from the building facade;

said elongated rail defining a protrusion portion that protrudes beyond an end of said locking bar; and said elongated rail protruding portion being configured to be countersunk between said locking bar and the building structure.

* * * * *

UNITED STATES PATENT AND TRADEMARK OFFICE

CERTIFICATE OF CORRECTION

PATENT NO. : 5,042,216

DATED : August 27, 1991

INVENTOR(S) : Hans STRATMANN and Franz-Josef SCHWEINS

It is certified that error appears in the above-identified patent and that said Letters Patent is hereby corrected as shown below:

column 3, line 48, delete "Embodiment" and insert --Embodiments--.

column 4, line 32, after 'are', delete "n the e" and insert --in the end--.

column 7, line 13, after 'additionally', insert --,--.

Col. 9, Claim 1, line 41, after 'structure', insert --,--.

Col. 10, Claim 3, line 1, after 'device', delete "is" and insert --of--.

Col. 11, Claim 15, line 12, after the first instance of 'threaded', delete "openings" and insert --opening--.

Col. 12, Claim 16, line 20, after 'into', insert --a--.

Signed and Sealed this

Twenty-third Day of February, 1993

*Attest:*

STEPHEN G. KUNIN

*Attesting Officer*

*Acting Commissioner of Patents and Trademarks*